US005159867A

United States Patent [19]

Arana Erana

[11] Patent Number: 5,159,867

[45] Date of Patent: Nov. 3, 1992

[54] CORE COLLECTING TRAY PROVIDED WITH AN IN-BUILT CLIPPING SYSTEM AND ADJUSTABLE CROSS TRAVEL ALLOWING THE CORE TO BE CENTRED WITH THE MANIPULATOR SHAFT

[76] Inventor: D. Agustin Arana Erana, Zorrostea, 4, Pol. Ind. Ali Gobeo, 01010 Vitoria (Alava), Spain

[21] Appl. No.: 546,352

[22] Filed: Jun. 29, 1990

[30] Foreign Application Priority Data

Jul. 26, 1989 [ES] Spain ..... 8902644

[51] Int. Cl.[5] ..... B65G 7/00

[52] U.S. Cl. ..... 83/418; 269/24; 269/56; 414/663; 414/749; 414/222; 83/914; 425/806

[58] Field of Search ..... 414/222, 589, 495, 401, 414/402, 662, 663, 671, 667; 425/218, 289, 317, 403.1, 383, 457, 806; 269/20, 24, 58, 56, 35; 83/914, 418

[56] References Cited

U.S. PATENT DOCUMENTS

| | | | |
|---|---|---|---|
| 2,987,205 | 6/1961 | Draxler | 414/663 |
| 4,254,711 | 3/1981 | Langlitz et al. | 414/663 X |
| 4,797,989 | 1/1989 | Cherko | 414/222 X |
| 4,971,508 | 11/1990 | Miyahara et al. | 414/282 |

FOREIGN PATENT DOCUMENTS

| | | | |
|---|---|---|---|
| 2011993 | 9/1971 | Fed. Rep. of Germany | 425/806 R |
| 343784 | 7/1972 | U.S.S.R. | 425/806 R |

*Primary Examiner*—Frank E. Werner
*Attorney, Agent, or Firm*—Helfgott & Karas

[57] ABSTRACT

A core collecting tray for a core blowing machine is provided which forms part of a slide which can reciprocally move longitudinally on tracks through sheaves, be lifted by a hydraulic cylinder that acts on a deck and with the assistance of vertical guides. The tray is adapted to cross travel by a further hydraulic cylinder and is fitted with a clipping template which can in turn travel upwards on additional guides and with the assistance of a third hydraulic cylinder.

2 Claims, 1 Drawing Sheet

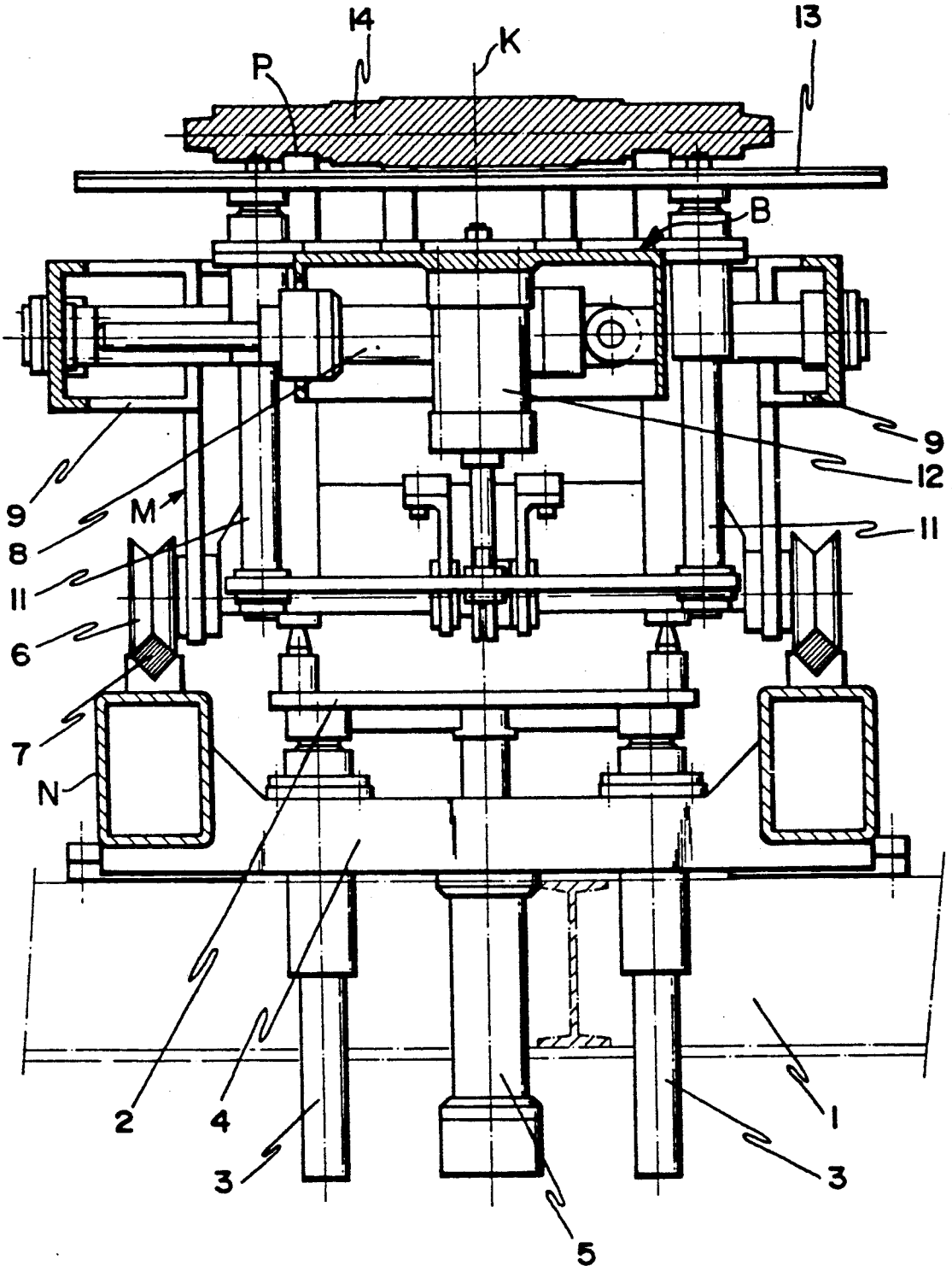
14
K
13
P
B
9
12
9
M
8
11
11
6
7
N
2
4
3
1
3
5

CORE COLLECTING TRAY PROVIDED WITH AN IN-BUILT CLIPPING SYSTEM AND ADJUSTABLE CROSS TRAVEL ALLOWING THE CORE TO BE CENTRED WITH THE MANIPULATOR SHAFT

FIELD OF THE INVENTION

The present invention relates to a core collecting tray, designed to be built in a core blowing machine, such tray to be provided with a clipping system to attain a perfect surface finish of the cores, and moreover provided with cross travel means, of adjustable range, so that the cores can be centered with the axis of the manipulator that removes the same from the tray to form a packet.

BACKGROUND OF THE INVENTION

In core blowing machines, upon completion of the blowing of each core, the cores fall on a tray within which they take up a position with respect to the side edges thereof, where they collect and are subsequently removed by a manipulator that conveys them to another work station where the relevant cores of a given packet are duly locked together by different means.

The problems derived from this operating solution are as follows:

On the one hand, the cores fall into line within the tray at one of the edges thereof and not its axis of symmetry, upon which the manipulator shall act.

Furthermore, the cores leave the blower with burrs that in turn bring about positional variations depending on their different size, this also leading to axial skew of the actual cores.

Finally, cores can be damaged when falling onto the tray by the actual impact and sometimes depending on the height of fall.

When such trays, on which the manipulator acts directly, are not used, conveyor belts are employed, in which event the cores are wholly misguided and hence subsequent manual and tedious work is required to line up and orient the same.

SUMMARY OF THE INVENTION

The core collecting tray, subject of the present invention has been designed to fully overcome the above problem and to such end the tray is provided, besides the usual longitudinal travel means for the removal thereof from the blowing machine, with cross travel means that, upon receipt of the group of cores, allow the same to be placed in line with the axis of a manipulator, with lifting means allowing, on the one hand, the tray to be drawn as close as necessary to the blowing area to receive the cores with a negligible impact, and, on hand, other the said cores to travel through a clipping template, to be rid of possible burrs produced during the core blowing or moulding and so that such burrs do not hinder positioning of the cores.

More specifically, the tray comprises a slide that can travel by means of sheaves on relevant tracks, which slide in duly power-driven and can be lifted towards the core deposition area, becoming detached from the tracks, with the assistance of a deck that can travel vertically by means of a hydraulic cylinder and is duly assisted by vertical guides.

Cross travel of the tray as such within the slide takes place with the assistance of another hydraulic cylinder, obviously placed across, whereas for the clipping operation, specifically for relative travel between the template and the tray, such template is driven by a third hydraulic cylinder, disposed vertically, being moreover able to travel on likewise vertical guides.

BRIEF DESCRIPTION OF THE DRAWINGS

In order to complete the description being made and to assist a better understanding of the characteristics of the invention, a single sheet of drawings is attached to the present specification, as an integral part thereof, its only figure showing, in an illustrative and non limiting manner, an axial view of a core collecting tray made in accordance with the object hereof and provided with its relevant fittings.

DETAILED DESCRIPTION OF THE PREFERRED EMBODIMENT OF THE INVENTION

In the light of this figure it can be observed that the assembly rests on sections (1) to which a track holder (4), fitted with vertical guides (3) for a deck (2) driven by a vertical travel hydraulic cylinder (5) to travel, is specifically attached. A travelling slide M for holding a tray B as such is placed on such deck (2), such slide being fitted with sheaves (6) through which it habitually rests and travels on tracks (7) in a horizontal direction, duly provided on a frame N of track holder (4). Slide M becomes detached from tracks (7) when, upon deposition of each core, the tray B as such rises through the actuation of the hydraulic cylinder (5) that lifts the whole slide M by means of the deck (2).

Once inside the slide, the tray B supporting cores 14 on protrusions P provided on the tray can travel across, also horizontally, with the assistance of a hydraulic cylinder (8) that acts between two end boxes (9) and evidently provides the tray as such with the desired horizontal cross movement for a due axial lining up of the various cores that reach the tray.

Finally and as a complement to the aforedescribed structure, within the slide M there are vertical guides (11), and a third hydraulic cylinder (12) that moves a clipping template (13) positioned on guides (11) and, upon actuation of the cylinder (12), the clipping template (13) is vertically moved to permit the core (14) to which it formally and dimensionally adjusts to travel therethrough so that all possible burrs existing on the core edges will be eliminated. The cores can thus be moved to any adjusted position so that they can be centered with the axis of a manipulator shaft K.

It is not considered necessary to extend the present description any further for a person skilled in the art to grasp the full scope of the invention and the advantages derived therefrom.

The materials, shape, size and arrangement of the elements may very, provided this implies no modification of the essence of the invention.

The terms used in this specification should be taken to have a broad and non limiting meaning.

I claim:

1. A core collecting tray, comprising a clipping system for cores; a tray positioned below said clipping system and having a supporting surface for supporting cores thereon; a fixed bearing frame carrying tracks and having vertical guides; and travel means for moving the cores to allow said cores to be centered with an axis of a manipulator shaft, said travel means including a slide for holding said tray, said slide being provided with rotatable sheaves supported on said tracks for longitudinal movement of said slide in a first horizontal direction, a deck positioned on said vertical guides and supporting said slide in an operative position and being detachable from said slide in an inoperative position, a first hydraulic cylinder for a vertical displacement of said deck to vertically displace said slide with said tray towards a core blowing area, and a second hydraulic cylinder positioned horizontally on and across said slide to displace the tray in a second horizontal direction orthogonally of said first horizontal direction, said clipping system including a clipping means for cores collected on the tray to eliminate burrs on edges of the cores.

2. The core collecting tray according to claim 1, wherein said clipping means includes a clipping template designed for each type of a specific core; and further comprising additional guides positioned within said slide and supporting said template, and a third hydraulic cylinder mounted between the slide and template for a vertical displacement of said template to permit the cores to travel through said clipping template to eliminate burrs on said edges of the cores.

* * * * *